US008191989B2

(12) United States Patent
Inada

(10) Patent No.: US 8,191,989 B2
(45) Date of Patent: Jun. 5, 2012

(54) PRINTING APPARATUS AND RECOVERING METHOD THEREFOR

(75) Inventor: Genji Inada, Koshigaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 231 days.

(21) Appl. No.: 12/761,906

(22) Filed: Apr. 16, 2010

(65) Prior Publication Data

US 2010/0271420 A1 Oct. 28, 2010

(30) Foreign Application Priority Data

Apr. 28, 2009 (JP) ..... 2009-109912

(51) Int. Cl.
*B41J 2/165* (2006.01)

(52) U.S. Cl. ..... 347/30; 347/29; 347/22; 347/23; 347/35

(58) Field of Classification Search ..... 347/30, 347/29, 22, 23, 35
See application file for complete search history.

(56) References Cited

U.S. PATENT DOCUMENTS

| | | | | |
|---|---|---|---|---|
| 5,500,658 | A | 3/1996 | Hattori et al. | |
| 5,781,204 | A | 7/1998 | Kanematsu et al. | |
| 5,900,889 | A * | 5/1999 | Tsukuda | 347/23 |
| 6,149,261 | A | 11/2000 | Kuwabara et al. | |
| 6,390,578 | B1 | 5/2002 | Koitabashi et al. | |
| 7,434,920 | B2 | 10/2008 | Noguchi et al. | |
| 2009/0051725 | A1 * | 2/2009 | Ide et al. | 347/23 |

FOREIGN PATENT DOCUMENTS

| | | | |
|---|---|---|---|
| JP | 6-040043 | A | 2/1994 |
| JP | 7-132618 | A | 5/1995 |
| JP | 8-039833 | A | 2/1996 |
| JP | 8-267786 | A | 10/1996 |
| JP | 9-290517 | A | 11/1997 |
| JP | 2005-349730 | A | 12/2005 |
| JP | 2007-223160 | A | 9/2007 |

* cited by examiner

*Primary Examiner* — Matthew Luu
*Assistant Examiner* — Henok Legesse
(74) *Attorney, Agent, or Firm* — Fitzpatrick, Cella, Harper & Scinto

(57) ABSTRACT

A printing apparatus comprises: a temperature sensor configured to detect an environmental temperature of the printing apparatus; a suction unit configured to suck ink from a printhead according to a target suction amount indicating amount of ink that the suction unit should suck per unit time at a predetermined environmental temperature; and a controller configured to cause the suction unit to suck ink such that the target suction amount in a case where the environmental temperature is higher than a predetermined temperature is greater than the target suction amount in a case where the environmental temperature is lower than the predetermined temperature.

8 Claims, 6 Drawing Sheets

FIG. 5

| TANK REPLACEMENT RECOVERY OPERATION | REFRESHING OPERATION | FIRST SUCTION PEAK | | SECOND SUCTION PEAK | | SELECTION CONDITION |
|---|---|---|---|---|---|---|
| | | OPERATING SPEED | ROTATION AMOUNT | OPERATING SPEED | ROTATION AMOUNT | |
| | R1 | 100% | 100% | 83% | 78% | OVER REFERENCE TEMPERATURE (17.5) |
| T2 | R2 | 92% | 94% | 80% | 73% | REFERENCE TEMPERATURE (17.5) OR LOWER |
| T1 | | 100% | 94% | 80% | 73% | OVER REFERENCE TEMPERATURE (17.5), CONFORMITY TIME (90 MINUTES) OR SHORTER |
| T3 | | 100% | 100% | 83% | 78% | OVER REFERENCE TEMPERATURE (17.5), OVER CONFORMITY TIME (90 MINUTES) |

FIG. 6

| | FIRST SUCTION PEAK | | SECOND SUCTION PEAK | | SUCTION AMOUNT PER UNIT TIME (g/s) | | | |
|---|---|---|---|---|---|---|---|---|
| | NEGATIVE PRESSURE atm | TIME s | NEGATIVE PRESSURE atm | TIME s | Y | C | K | M |
| R1,T3 | 0.19 | 3.3 | 0.15 | 3.1 | 0.066 | 0.086 | 0.066 | 0.086 |
| R2,T2 | 0.18 | 3.3 | 0.15 | 3.0 | 0.061 | 0.079 | 0.060 | 0.076 |
| T1 | 0.19 | 3.2 | 0.15 | 3.0 | 0.059 | 0.079 | 0.061 | 0.075 |

"TIME" MEANS WAVEFORM RISING TIME

FIG. 7

| | R1,T3 | | R2,T2 |
|---|---|---|---|
| | (25°C) | (5°C) | (5°C) |
| Y | 0.42 | 94% | 86% |
| C | 0.55 | 86% | 79% |
| K | 0.42 | 89% | 82% |
| M | 0.55 | 85% | 80% |
| RUNNING OUT OF INK | ○ (NO) | × (YES) | ○ (NO) |

FIG. 8

| | T1 | | |
|---|---|---|---|
| | STATE 1 | STATE 2 | STATE 3 |
| Y | 79%(5°C) | 81%(5°C) | 86%5°C) |
| C | 94%(25°C) | 77%(5°C) | 79%(5°C) |
| K | 96%(25°C) | 74%(5°C) | 84%(5°C) |
| M | 92%(25°C) | 95%(25°C) | 82%(5°C) |
| RUNNING OUT OF INK | ○ (NO) | ○ (NO) | ○ (NO) |

| | R2 |
|---|---|
| | STATE 2 |
| Y | 80%(5°C) |
| C | 74%(5°C) |
| K | 83%(5°C) |
| M | 95%(25°C) |

PRINTING APPARATUS AND RECOVERING METHOD THEREFOR

BACKGROUND OF THE INVENTION

1. Field of the Invention

The present invention relates to a printing apparatus and a recovering method therefor.

2. Description of the Related Art

Printing apparatuses that print information such as text and images on printing media have been known. Examples of a printing method adopted in such printing apparatuses include an inkjet printing method that uses ink for printing. A printing apparatus using such an inkjet printing method (hereinafter, referred to as an inkjet printing apparatus or a printing apparatus) is provided with an ink tank for storing ink. As an example of an ink tank, a combined type ink tank is known that has a negative pressure generation chamber, an ink storage chamber that is communicated only with the negative pressure generation chamber, and a supply orifice for supplying ink from the negative pressure generation chamber (Japanese Patent Laid-Open No. 06-040043).

Here, such a printing apparatus is configured to perform various recovery operations to recover poor ink discharge. Examples of a recovery operation include a refreshing operation performed in order to recover printing quality. A user gives an instruction to execute this recovery operation. Also, the above examples include a tank replacement recovery operation performed in order to remove air bubbles taken in from a joint portion between an ink tank and a printhead when the ink tank is attached/detached. This recovery operation is automatically performed immediately after tank replacement, or before the start of the first printing processing after tank replacement.

Examples of a recovery unit include a capping mechanism to cap a discharge orifice surface of the printhead. With the recovery unit, ink is compulsorily discharged from the discharge orifice using a suction unit (such as a suction pump) in conjunction with the discharge orifice surface being capped by the capping mechanism. Further, technology for changing suction control according to the environmental temperature of a printing apparatus is known. For example, if the environmental temperature is high, the solubility of air will fall. In this case, since bubbles, which cause poor discharge, tend to remain in a nozzle, "strong suction (for example, suction for which a suction amount per unit time is comparatively large)" is suitable. On the other hand, if the environmental temperature is low, "weak suction (for example, suction for which a suction amount per unit time is comparatively small)" is performed, and thus wasteful ink consumption can be suppressed when removing bubbles. As known techniques for selecting a recovery operation by detecting the environmental temperature, there is a system in which a temperature sensor is provided on the apparatus main body side (Japanese Patent Laid-Open No. 08-267786, Japanese Patent Laid-Open No. 09-290517), and a system in which a temperature sensor is provided on the ink tank side that is to be replaced (Japanese Patent Laid-Open No. 2007-223160). In consideration of the fact that ink tanks are consumables, the system in which a temperature sensor is provided on the apparatus main body side is more advantageous in terms of cost. In the description below, a technique for changing suction control according to the environmental temperature may also be simply referred to as "environmental suction".

With the combined type ink tank, if a large amount of printing is performed in a short time, air corresponding to the amount of ink supply enters a liquid storage room, and thus the air-liquid interface lowers, and even reaches the ink supply orifice. It is known that this causes the occurrence of so-called "running out of ink", which is the state of no ink being supplied from an ink tank (Japanese Patent Laid-Open No. 2005-349730).

In regard to this, from the study done by the inventors of the present invention, it was found that the above "running out of ink" may occur not only when a large amount of printing is performed in a short time, but also when a suction recovery operation is performed. One of the causes for this is that an air path is formed in an absorbing member by rapidly sucking ink whose flow resistance has increased due to increased viscosity. In order to avoid this, in the state where the ink viscosity has increased due to a low ink temperature, it is necessary to discharge nozzle bubbles by performing "weak suction". With the apparatus that performs environmental suction described above, the problem of the above running out of ink does not occur since "weak suction" is implemented if it is detected that the environmental temperature is low. Further, in the state where the environmental temperature is high, and the ink temperature is also high, since the viscosity of ink is not very high, even if "strong suction" is implemented, running out of ink does not occur.

However, even though if the detected environmental temperature is high, if the actual ink temperature is low, "strong suction" will be implemented with respect to the ink whose viscosity has increased, and thus there is the possibility that ink may run out. For example, suppose that some of the ink tanks in a printing apparatus being used in an approximately 25° C. environment are replaced with ink tanks that have been saved in an approximately 5° C. environment. In this case, although the printing apparatus detects that the ink temperature is high based on the environmental temperature, the actual ink temperature is low.

Although the temperature of the replaced ink tanks will gradually conform to the temperature of the environment (25° C.) where they are placed as time elapses, if a suction operation is executed as part of a tank replacement recovery operation immediately after the replacement, it is detected that the environmental temperature is 25° C. even though the ink temperature has not reached 25° C., and thus a recovery operation using "strong suction" will be performed. At this time, a strong negative pressure will be applied on the low-temperature ink tanks, and thus there is the risk of the occurrence of running out of ink.

SUMMARY OF THE INVENTION

The present invention provides technology for preventing the occurrence of running out of ink due to a suction recovery operation, even if the detected environmental temperature and the actual ink tank temperature are different when environmental suction is implemented.

According to a first aspect of the present invention there is provided a printing apparatus that prints an image using a printhead that discharges ink supplied from an ink tank that has a negative pressure generation chamber, and an ink storage chamber that is communicated with the negative pressure generation chamber and is for holding ink, the printing apparatus comprising: a temperature sensor configured to detect an environmental temperature of the printing apparatus; a suction unit configured to suck ink from the printhead according to a target suction amount indicating amount of ink that the suction unit should suck per unit time at a predetermined environmental temperature; and a controller configured to cause the suction unit to suck ink such that the target suction amount in a case where the environmental temperature detected by the temperature sensor is higher than a predetermined temperature is greater than the target suction amount in a case where the environmental temperature is lower than the predetermined temperature, wherein the controller causes, in a case where the environmental temperature is higher than the predetermined temperature, the suction unit to suck ink such that the target suction amount for when an elapsed time since the ink tank was mounted is longer than a predetermined time is greater than the target suction amount for when the elapsed time is shorter than the predetermined time.

According to a second aspect of the present invention there is provided a method for recovering a printhead of a printing apparatus that prints an image using the printhead that discharges ink supplied from an ink tank that has a negative pressure generation chamber, and an ink storage chamber that is communicated with the negative pressure generation chamber and is for holding ink, the method comprising: detecting an environmental temperature of the printing apparatus; and sucking the ink such from the printhead that a target suction amount indicating amount of ink that a suction unit should suck per unit time at a predetermined environmental temperature, in a case where the environmental temperature is higher than a predetermined temperature is greater than the target suction amount in a case where the detected environmental temperature is lower than the predetermined temperature, wherein in the suction, in a case where the environmental temperature is higher than the predetermined temperature, ink is sucked such that the target suction amount for when an elapsed time since the ink tank was mounted is longer than a predetermined time is greater than the target suction amount for when the elapsed time is shorter than the predetermined time.

Further features of the present invention will become apparent from the following description of exemplary embodiments with reference to the attached drawings.

BRIEF DESCRIPTION OF THE DRAWINGS

FIG. 5 is a first diagram showing specific examples based on the results of an experiment of the recovery operation according to Embodiment 1.

FIG. 6 is a second diagram showing specific examples based on the results of the experiment of the recovery operation according to Embodiment 1.

FIG. 7 is a third diagram showing specific examples based on the results of the experiment of the recovery operation according to Embodiment 1.

FIG. 8 is a fourth diagram showing specific examples based on the results of the experiment of the recovery operation according to Embodiment 1.

DESCRIPTION OF THE EMBODIMENTS

Exemplary embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

Preferred embodiments of the present invention will be described in detail below with reference to the accompanying drawings. In the following description, a printing apparatus using an inkjet printing method will be exemplified. The printing apparatus using the inkjet printing method may be, for example, a single-function printer having only a print function, or a multi-function printer having a plurality of functions including a print function, FAX function, and scanner function. Also, the printing apparatus using the inkjet printing method may be a manufacturing apparatus for manufacturing a color filter, electronic device, optical device, microstructure, or the like by the inkjet printing method.

In this specification, "printing" means not only forming significant information such as characters or graphics but also forming, for example, an image, design, pattern, or structure on a printing medium in a broad sense regardless of whether the formed information is significant, or processing the medium as well. In addition, the formed information need not always be visualized so as to be visually recognized by humans.

Also, a "printing medium" means not only a paper sheet for use in a general printing apparatus but also a member which can fix ink, such as cloth, plastic film, metallic plate, glass, ceramics, resin, lumber, or leather in a broad sense.

Also, "ink" should be interpreted in a broad sense as in the definition of "printing" mentioned above, and means a liquid which can be used to form, for example, an image, design, or pattern, process a printing medium, or perform ink processing upon being supplied onto the printing medium. The ink processing includes, for example, solidification or insolubilization of a coloring material in ink supplied onto a printing medium.

Embodiment 1

Figure 1:
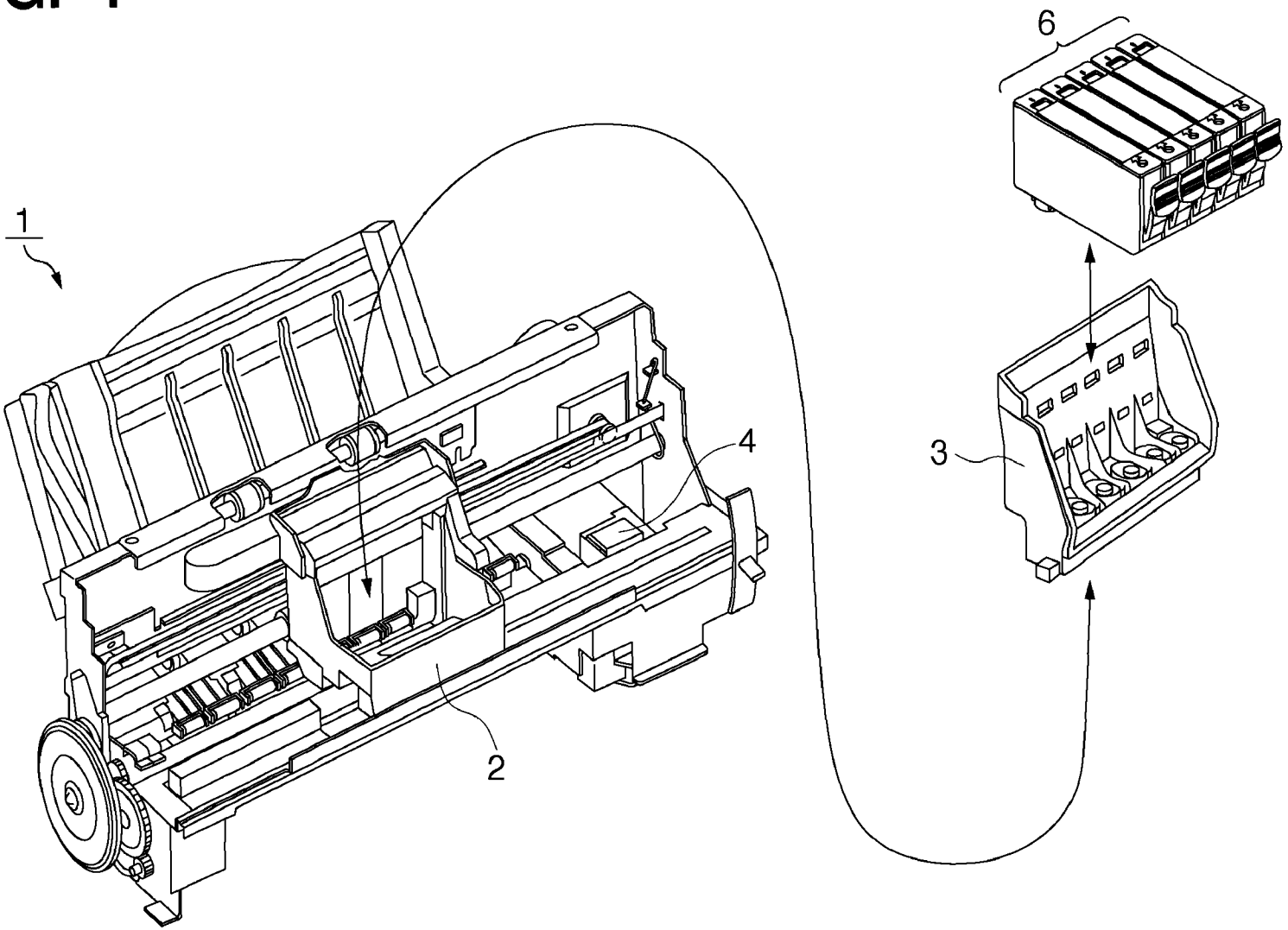
FIG. 1 is a perspective view showing an example of the outer configuration of an inkjet printing apparatus 1 according to one embodiment of the present invention.

FIG. 1 is a perspective view showing an example of the outer arrangement of an inkjet printing apparatus 1 according to one embodiment of the present invention. It should be noted that a description is given assuming that in the present embodiment, since ink is contained in an ink tank, the ink temperature and the ink tank temperature are substantially the same.

The inkjet printing apparatus (to be simply referred to as a printing apparatus hereinafter) 1 includes an inkjet printhead (to be simply referred to as a printhead hereinafter) 3 which is mounted on a carriage 2 and prints by discharging ink in accordance with the inkjet scheme. The printing apparatus 1 prints by reciprocally moving the carriage 2 in a predetermined direction. The printing apparatus 1 supplies a printing medium such as a printing sheet via a sheet supply mechanism and conveys it to the printing position. The printing apparatus 1 prints at the printing position by discharging ink from the printhead 3 to the printing medium.

The printhead 3 according to this embodiment adopts the inkjet scheme in which ink is discharged using thermal energy. For this reason, the printhead 3 includes electrothermal transducers. The electrothermal transducers are disposed in correspondence with respective discharge orifices, and a pulse voltage is applied to a corresponding electrothermal transducer in accordance with a printing signal. With this operation, ink is discharged from a corresponding discharge orifice.

The carriage 2 is provided with a temperature sensor (denoted by reference numeral 632 shown in FIG. 2 described later) that detects the temperature in the apparatus (specifically, the carriage scanning space) as the environmental temperature. The printing apparatus 1 selects, when performing a tank replacement recovery operation or a refreshing operation, a suction parameter from a recovery system operation table according to the temperature detected using the temperature sensor (hereinafter, referred to as a detection temperature), and implements a suction recovery operation in accordance with the suction parameter.

Here, there are two recovery operations according to the present embodiment, namely a first recovery operation and a second recovery operation. The first recovery operation is a refreshing operation, which is executed in response to a user instruction. The second recovery operation is a tank replacement recovery operation, which is automatically performed immediately after tank replacement, or before the first printing processing starts after tank replacement, for example. The processing content of the suction recovery operation in the refreshing operation and the tank replacement recovery operation is changed according to a detection temperature. This is performed by comparing a detection temperature and a predetermined temperature (hereinafter, a reference temperature) when the suction recovery operation is executed. For example, if the detection temperature exceeds the reference temperature, the suction recovery operation is executed in accordance with a suction parameter for a high-temperature mode, and if not, the suction recovery operation is executed in accordance with a suction parameter for a low-temperature mode. Note that it is desirable to set the reference temperature to a value that is equal to or smaller than that of the temperature of the environment where the printing apparatus is ordinarily used (for example, 25° C. or lower). The tank replacement recovery operation is a recovery operation series performed in order to, for example, remove air bubbles taken in from a joint portion between an ink tank 6 and the printhead 3 when an ink tank is attached/detached.

The ink tank 6 is mounted in the carriage 2. The ink tank 6 contains ink to be supplied to the printhead 3. In the case of the printing apparatus 1 shown in FIG. 1, five ink tanks 6 are mounted in the carriage 2, and respectively contain mat black (MBk), magenta (M) cyan (C), yellow (Y), and black (K) ink. Each of the five ink tanks 6 can be independently attached/detached.

The ink tank 6 is constituted from a combined type ink tank that has a negative pressure generation chamber, an ink storage chamber that is communicated only with the negative pressure generation chamber, and a supply orifice for supplying ink from the negative pressure generation chamber (see Japanese Patent Laid-Open No. 06-040043). Note that an optical sensor or the like (not shown) that detects that the ink tank 6 has been replaced is provided on the apparatus main body side (the main body of the printing apparatus 1).

At one end of the carriage scanning space, a capping mechanism 4 is provided that caps the discharge orifice surface of the printhead 3. The capping mechanism 4 is provided with for example, a cap for capping MBk, and a cap for capping the four colors C, M, Y, and K, at the same time.

Here, for example, suppose that poor discharge has occurred due to paper powder adhering to the discharge orifice surface of the printhead 3, for instance. In this case, the user gives an instruction to the printing apparatus 1 to perform the refreshing operation. In the refreshing operation, the printhead 3 moves to the position where the capping mechanism 4 is provided, and thus the caps are brought into contact with the printhead 3. Then, the capped space is decompressed by the operation of a suction unit (for example, a suction pump). Accordingly, ink is compulsorily discharged from the discharge orifice. A suction pump may be provided for each cap, or two capped spaces may be decompressed using one suction pump.

As described above, although the tank replacement recovery operation and the refreshing operation include the suction recovery operation performed by the suction unit, other recovery operations may be performed in addition to the suction recovery operation. For example, by implementing a preliminary discharge operation after the suction recovery operation, it is possible to prevent color mixture of ink, which may occur along with the suction recovery operation.

Figure 2:
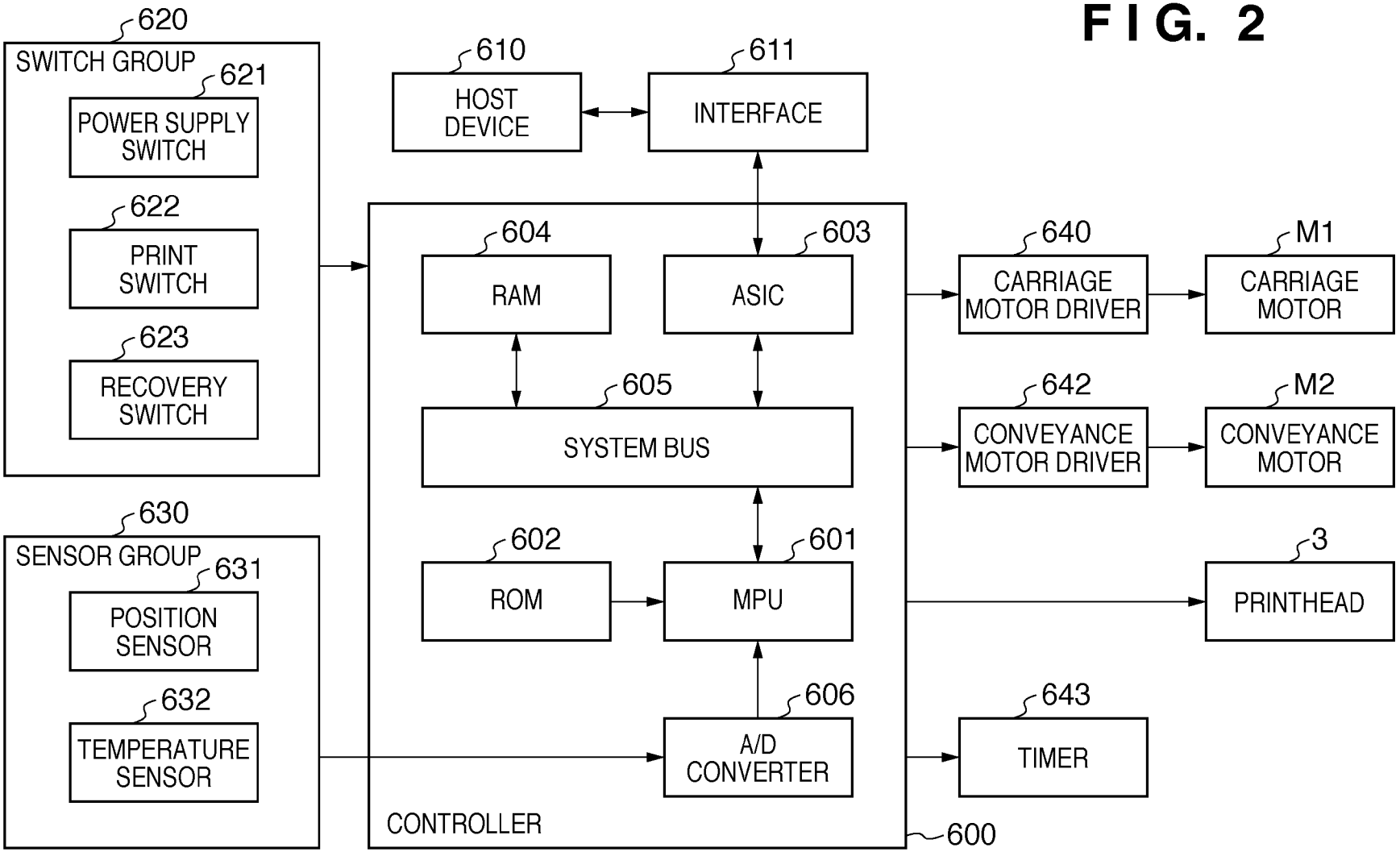
FIG. 2 is a diagram showing an example of the functional configuration of the printing apparatus 1 shown in FIG. 1.

FIG. 2 is a block diagram showing an example of the functional configuration of the printing apparatus 1 shown in FIG. 1.

A controller 600 includes, e.g., an MPU 601, ROM 602, ASIC (Application Specific Integrated Circuit) 603, RAM 604, system bus 605, and A/D converter 606. The ROM 602 stores a program corresponding to a control sequence (to be described later), necessary tables, and other fixed data. The ASIC 603 controls a carriage motor M1 and conveyance motor M2. Also, the ASIC 603 generates a signal to control the printhead 3. The RAM 604 is used as, e.g., an image data rasterization area and a working area for program execution. The system bus 605 connects the MPU 601, ASIC 603, and RAM 604 to each other to transfer data among them. The A/D converter 606 A/D-converts an analog signal input from a sensor group (to be described later) and supplies the converted digital signal to the MPU 601.

A switch group 620 includes, e.g., a power supply switch 621, print switch 622, and recovery switch 623. A sensor group 630 for detecting the apparatus state includes, e.g., a position sensor 631 and temperature sensor 632. In print scanning by the printhead 3, the ASIC 603 transfers data to drive a printing element (discharge heater) to the printhead 3 while directly accessing the storage area of the RAM 604.

The carriage motor M1 is a driving source for reciprocally scanning the carriage 2 in the predetermined direction, and a carriage motor driver 640 controls the driving of the carriage motor M1. The conveyance motor M2 is a driving source for conveying the printing medium, and a conveyance motor driver 642 controls the driving of the conveyance motor M2. The printhead 3 is scanned in a direction (to be referred to as the scanning direction hereinafter) perpendicular to the direction in which the printing medium is conveyed. Reference numeral 643 denotes a timer, which is used for measuring the elapsed time since an ink tank was mounted.

A computer (or, e.g., an image reader or a digital camera) 610 serving as an image data supply source is generically called, for example, a host device. Image data, commands, and status signals, for example, are transferred between the host device 610 and the printing apparatus 1 via an interface (to be abbreviated as an I/F hereinafter) 611.

The above has been a description regarding an example of the configuration of the printing apparatus 1. Here, suppose that the environmental temperature of the printing apparatus 1 is approximately 25° C., and some of the ink tanks 6 thereof have been replaced with ink tanks that had been stored in an approximately 5° C. environment. In this case, ink tanks whose actual ink temperatures are low exist in the printing apparatus 1. The temperature of the replaced ink tanks will gradually conform to the temperature of the environment (25° C.) where they are placed, as time elapses. In the present embodiment, the time period necessary for the ink temperature of an ink tank to reach the same temperature (or almost the same temperature) as the environmental temperature (or a detection temperature) is referred to as a conformity time, and the value obtained by estimating this conformity time is referred to as an estimation conformity time.

Note that the speed at which the ink temperature changes is determined depending on the heat capacity of an ink tank if in the state where a phase change such as freezing does not occur. Accordingly, irrespective of the difference between the ink temperature of an ink tank to be replaced and the environmental temperature, the time period until when the ink temperature conforms to the environmental temperature after tank replacement is almost constant. According to the result of an experiment on ink tanks, a conformity time of approximately 80 minutes was necessary for both of the cases where the ink temperature of an ink tank changed from 5° C. to 30° C., which was the environmental temperature, and where the ink temperature of an ink tank changed from 25° C. to 15° C., which was the environmental temperature. In this experimental result, there was no time difference between ink colors.

In view of the above, in the present embodiment, the estimation conformity time until when the ink temperature of a replaced ink tank reaches the environmental temperature is set to 90 minutes. If ink in ink tanks with different heat capacities is sucked at the same time using the suction unit, it is sufficient to set the estimation conformity time in accordance with the ink tank that has the longest conformity time.

Figure 3:
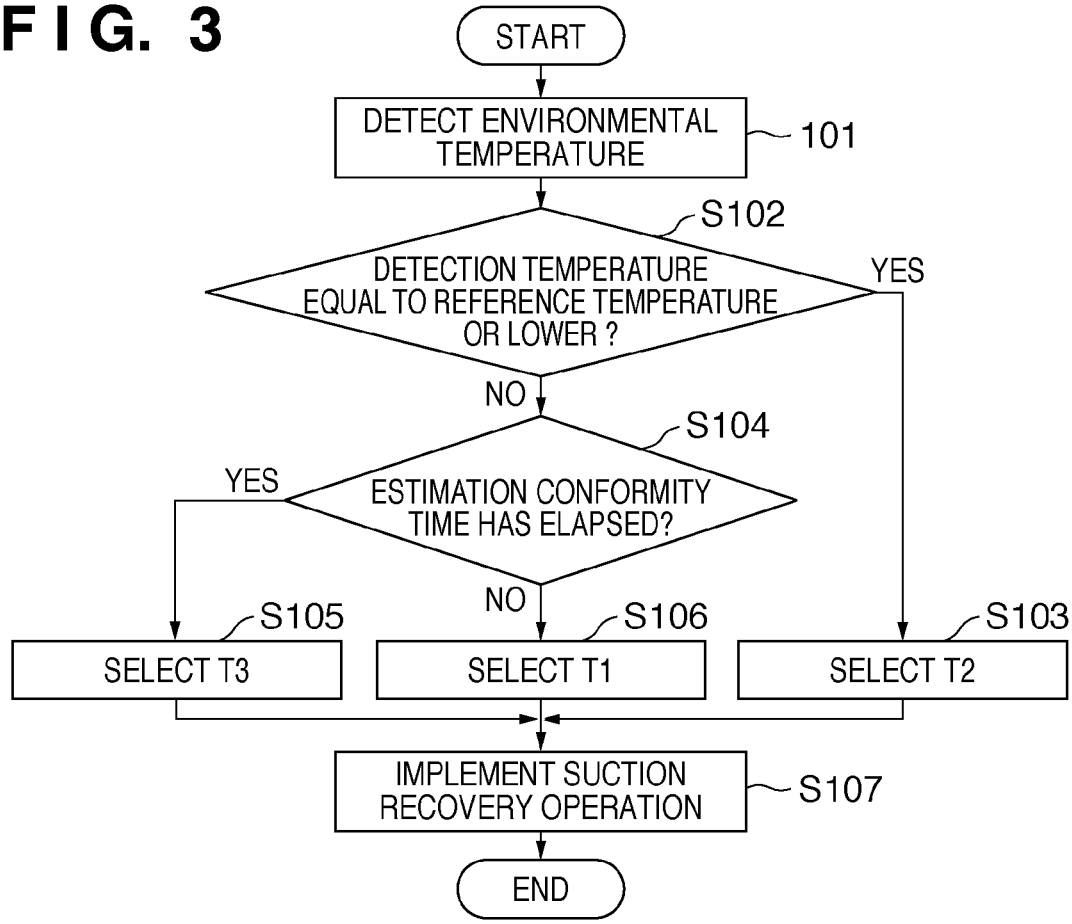
FIG. 3 is a flowchart showing an example of the flow of a recovery operation performed by the printing apparatus 1 shown in FIG. 1.

Here, an example of the flow of a recovery operation performed by the printing apparatus 1 shown in FIG. 1 is described with reference to FIG. 3. Here, the tank replacement recovery operation is described as an example of the recovery operation. Note that examples of the time when the tank replacement recovery operation is executed include automatic execution immediately after tank replacement, and automatic execution prior to the start of the first printing processing after tank replacement. In the latter case, there is the possibility that the tank replacement recovery operation is executed after the estimation conformity time (90 minutes in the present embodiment) has elapsed after tank replacement.

When this processing starts, the printing apparatus 1 detects the environmental temperature of the printing apparatus 1 using the temperature sensor 632 (S101), and compares the detected environmental temperature (in other words, the detection temperature) and the reference temperature (17.5° C. in this embodiment) using the controller 600. As a result of the comparison, if the detection temperature is equal to the reference temperature or lower (YES in S102), the controller 600 of the printing apparatus 1 selects a suction parameter T2 (S103).

Figure 4:
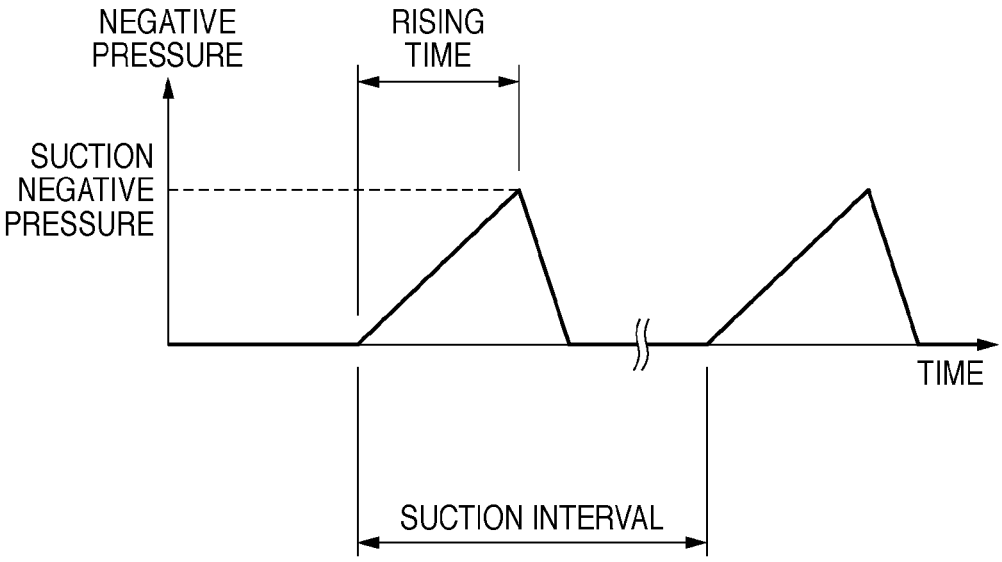
FIG. 4 is a diagram showing an example of a suction waveform when the recovery operation is performed by the printing apparatus 1 shown in FIG. 1.

On the other hand, if the detection temperature exceeds the reference temperature (NO in S102), the controller 600 of the printing apparatus 1 determines whether or not the estimation conformity time has elapsed after tank replacement. As a result of this, if the estimation conformity time has elapsed (YES in S104), the controller 600 of the printing apparatus 1 selects a suction parameter T3 (S105). If the estimation time has not elapsed (NO in S104), the controller 600 of the printing apparatus 1 selects a suction parameter T1 (S106). After having selected a suction parameter in this way, the printing apparatus 1 implements the suction recovery operation in accordance with the selected suction parameter (S107). Note that the suction recovery operation is performed by sucking two times (so-called two-peak suction), for example, as shown in FIG. 4. By alternately providing a period when a suction negative pressure is applied, and a period when a suction negative pressure is not applied, as in this two-peak suction, a large amount of ink is not discharged at once, and thus the occurrence of running out of ink can be further suppressed.

The above has been an example of the processing flow of the tank replacement recovery operation. Note that a detailed description regarding the refreshing operation is omitted. To give a brief description, in the refreshing operation according to the present embodiment, if a detection temperature exceeds the reference temperature, a suction parameter R1 is selected, and if not, a suction parameter R2 is selected. Then, the suction recovery operation is implemented in accordance with the one of the suction parameters. Note that in the suction recovery operation in accordance with R1, recovery processing is performed using "strong suction" that is stronger compared to the suction recovery operation in accordance with R2.

In this way, the printing apparatus 1 according to the present embodiment selects a suction parameter according to the detection temperature detected using the temperature sensor 632, and implements the suction recovery operation in accordance with the suction parameter.

Here, a description is given regarding the recovery operations described above with reference to FIGS. 5 and 6. R1, R2, and T1 to T3 shown in FIGS. 5 and 6 correspond to the suction parameters described above with reference to FIG. 3.

FIG. 5 shows an operation table that shows examples of suction parameters used when the suction recovery operation is performed.

FIG. 5 (Table 1) shows R1 and R2 as suction parameters used when the refreshing operation is executed, and T1 to T3 as suction parameters used when the tank replacement recovery operation is executed. In the suction recovery operation performed in accordance with R1, R2, and T1 to T3, suction is performed two times (so-called two-peak suction) as described above (see FIG. 4). The values shown in FIG. 5 are values obtained in the case where the operating speed and rotation amount of a pump that make the suction waveform of the first peak when the suction recovery operation in accordance with R1 is executed were respectively set to 100%. R1 indicates a suction parameter preferable to recovery of the printing performance of the printing apparatus, in the case where the detection temperature exceeds the reference temperature (17.5° C.), that is, the detection temperature is comparatively high. R2 indicates a suction parameter preferable to recovery of the printing performance of the printing apparatus, in the case where the detection temperature is equal to the reference temperature (17.5° C.) or lower, that is, the detection temperature is comparatively low.

Here, suppose that the user has given an instruction to execute the refreshing operation. Also suppose that the detection temperature detected by the printing apparatus 1 at this time exceeded the reference temperature (17.5° C. in the present embodiment). In this case, the printing apparatus 1 selects the suction parameter R1 for the high-temperature mode, and executes the suction recovery operation in accordance with that parameter. Note that if the detection temperature is equal to the reference temperature or lower, the printing apparatus selects the suction parameter R2 for the low-temperature mode, and executes the suction recovery operation in accordance with that parameter.

As described with reference to FIG. 3, in the tank replacement recovery operation, if the detection temperature is equal to the reference temperature or lower, the suction parameter T2 for the low-temperature mode is selected, and if the detection temperature exceeds the reference temperature (17.5° C.), either the suction parameter T1 or T3 is selected. Then, the suction recovery operation in accordance with that parameter is executed.

Suppose that the estimation conformity time has elapsed after ink tank replacement. In the tank replacement recovery operation at this time, the printing apparatus selects not T1, but T3 as the suction parameter. This is because the ink temperature is considered to have reached the environmental temperature of the printing apparatus. Note that in FIG. 5, the suction parameters indicated by T2 are the same values as those of the suction parameters indicated by R2. Specifically, in the present embodiment, the same recovery operation is performed in the suction recovery operation in the tank replacement recovery operation executed when the detection temperature is equal to the reference temperature or lower, and in the suction recovery operation in the refreshing operation executed when the detection temperature is equal to the reference temperature or lower. Therefore, in the present embodiment, three types of suction parameters are substantially provided.

FIG. 6 shows suction amounts per unit time when the suction recovery operation was executed in accordance with the suction parameters shown in FIG. 5, at the same environmental temperature. The suction amounts per unit time at the same environmental temperature are shown in order to eliminate a change in the suction amount that accompanies a change in the ink viscosity due to a change in the temperature. That is, the suction parameter of the present embodiment defines the amount (target suction amount) of ink that the suction unit (suction pump) should suck during a unit time at a predetermined environmental temperature. FIG. 6 shows the greatest suction negative pressures and suction waveform rising times of the first suction peak and second suction peak, respectively. Also, suction amounts per unit time for each color when two-peak suction is implemented are shown. The suction amount per unit time is a value that indicates the amount of ink sucked during a unit time (predetermined time), and the unit time indicates, for example, in the case of two-peak suction, the time period in which a suction operation is being performed (a time period from when the first suction peak starts until when the second suction peak ends), for instance. Note that in the present embodiment, particularly, the sum of the rising times of two suction waveforms (first suction peak and second suction peak) is set to be the unit time, and the value obtained by dividing the suction amount by the sum of the rising times of the two suction waveforms is set to be the suction amount per unit time. This is because it is considered that running out of ink tends to occur while the force for sucking ink from the ink tank in continuously applied, specifically, during the rising times of the suction waveforms. However, no matter what time period in the suction operation time is determined as the unit time, it is sufficient to satisfy the relationship for the suction amount per unit time described below. Note that in the present embodiment, the unit time is set to the sum of the rising times of the suction waveforms (approximately 15 seconds) in any case irrespective of the suction parameters.

Next, cases of performing the refreshing operation when the environmental temperature is the same are compared. The suction negative pressure is slightly lower in the case where the refreshing operation is performed in accordance with R2 for the low-temperature mode, compared to the case where the refreshing operation is performed in accordance with R1 for the high-temperature mode. Further, the suction amounts per unit time for the low-temperature mode are also approximately 88% to 92% of those in the case where the refreshing operation is performed in accordance with R1.

Therefore, suction recovery in accordance with R1 and T3 is performed using so-called "strong suction (suction for which a suction amount per unit time is comparatively large)". This enables discharge of bubbles in a nozzle that appear in high-temperature ink in which the solubility of air falls. On the other hand, suction recovery in accordance with R2 and T2 is performed using so-called "weak suction (suction for which a suction amount per unit time is comparatively small)". This enables discharge of bubbles in a nozzle without wasteful ink consumption. Further, running out of ink can be prevented by slowly sucking ink whose viscosity has increased.

As shown in the fields for suction amounts per unit time, the suction amounts for T1 are smaller than those for R1 and T3. This is because there is the possibility that the ink temperature has not reached the environmental temperature. If the ink temperature is low, ink with low viscosity will be sucked with a strong negative pressure, and thus there is the risk of running out of ink. In the present embodiment, suction conditions for T1 are made almost the same as those for R2 and T2, and thus suction recovery processing is performed using "weak suction" that is weaker than when the suction recovery operation is performed in accordance with R1 and T3. Accordingly, the risk of sucking ink having low viscosity with strong negative pressure is eliminated, and thus it is possible to prevent the occurrence of running out of ink described above. Note that here, although the suction conditions for T1 indicate slightly stronger suction than that for R2 and T2, the suction conditions for T1 may be substantially the same as those for R2 and T2. That is, recovery control of the present embodiment has a feature that conditions for T1 in the case where the elapsed time since a tank is mounted is shorter than a predetermined time indicate weaker suction than conditions for T3 in the case where the elapsed time since a tank is mounted is longer than a predetermined time.

As described above, according to Embodiment 1, in the case of implementing environmental suction, the suction recovery operation is switched and implemented based on the elapsed time since tank replacement. More specifically, if the elapsed time since tank replacement is short, even if it is detected that the detection temperature exceeds the reference temperature, the suction recovery operation that is implemented is suction recovery according to which a suction amount per unit time is smaller than a suction amount per unit time in the case where the elapsed time is long.

Accordingly, the suction recovery operation using "strong suction" is not performed until the temperature of an ink tank conforms to the environmental temperature of the printing apparatus, and thus it is possible to suppress the running out of ink that may occur along with the suction recovery operation, due to the difference between the detection temperature and the ink tank temperature.

Embodiment 2

Next, Embodiment 2 is described. The configuration of a printing apparatus according to Embodiment 2 is the same as that shown in FIGS. 1 and 2 referenced in the description of Embodiment 1, and thus a description thereof is omitted. Here, the differences are mainly described. The differences from Embodiment 1 are in the selection of a suction parameter when the tank replacement recovery operation is performed. Note that the same processing is performed for the refreshing operation as that in Embodiment 1.

Figures 9, 10:
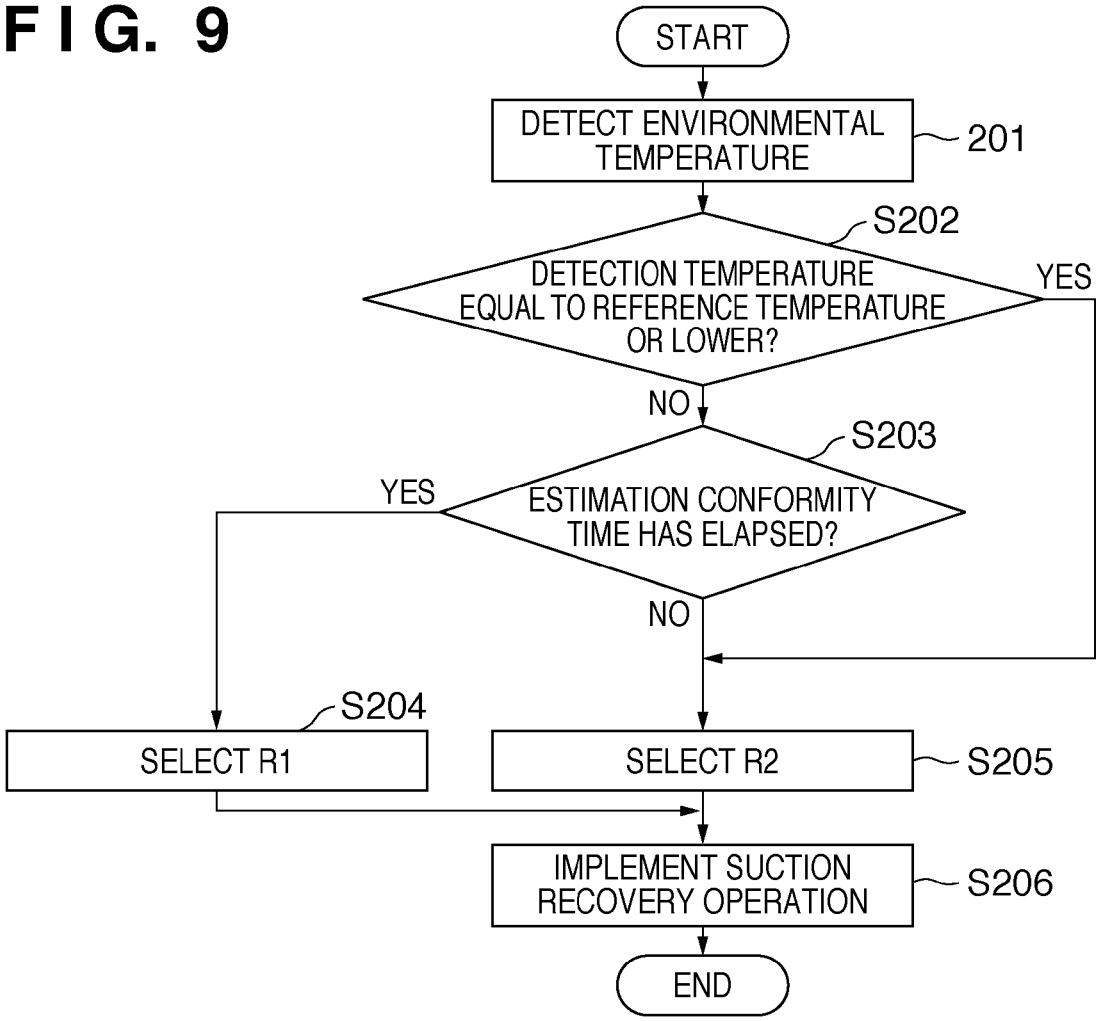
FIG. 9 is a flowchart showing an example of the flow of a recovery operation performed by the printing apparatus 1 according to Embodiment 2.
FIG. 10 is a diagram showing specific examples based on the results of the experiment of the recovery operation according to Embodiment 2.

Here, with reference to FIG. 9, a tank replacement recovery operation performed by the printing apparatus 1 according to Embodiment 2 is described. For suction parameters in this case, the case of using two types of suction parameters, namely R1 and R2, used when performing the refreshing operation described in Embodiment 1 is described as an example. Note that the relationship between R1 and R2 is that the suction amount for the suction recovery operation in accordance with R2 is smaller than the suction amount for the suction recovery operation in accordance with R1, as described above.

When this processing starts, the printing apparatus 1 detects the environmental temperature of the printing apparatus 1 using the temperature sensor 632 (S201), and compares the detected environmental temperature (in other words, the detection temperature) and the reference temperature using the controller 600. As a result of the comparison, if the detection temperature is equal to the reference temperature or lower (YES in S202), the controller 600 of the printing apparatus 1 selects the suction parameter R2 (S205).

On the other hand, if the detection temperature exceeds the reference temperature (NO in S202), the controller 600 of the printing apparatus 1 determines whether or not the estimation conformity time has elapsed after tank replacement. As a result of this, if the estimation conformity time has elapsed (YES in S203), the controller 600 of the printing apparatus 1 selects the suction parameter R1 (S204). If the estimation conformity time has not elapsed (NO in S203), the controller 600 of the printing apparatus 1 selects the suction parameter R2 (S205). After having selected a suction parameter in this way, the printing apparatus 1 implements the suction recovery operation in accordance with the selected suction parameter (S206).

As described above, according to Embodiment 2, until when the estimation conformity time elapses after tank replacement, even if the suction recovery operation is performed in accordance with the suction parameter R2 for the low-temperature mode irrespective of the detection temperature, the effect similar to that in Embodiment 1 can be obtained. Furthermore, according to the configuration of Embodiment 2, the memory consumption required for a suction recovery operation table (FIG. 5) can be suppressed.

Embodiment 3

Next, Embodiment 3 is described. The configuration of a printing apparatus according to Embodiment 3 is the same as that shown in FIGS. 1 and 2 referenced in the description of Embodiment 1, and thus the description thereof is omitted.

In Embodiment 3, the percentages of suction amounts per unit time for the low-temperature mode with respect to suction amounts per unit time for the high temperature mode are set smaller when performing the tank replacement recovery operation than when performing the refreshing operation. With this configuration, the suction strength in the high temperature mode when compared with that in the low-temperature mode is less when performing the tank replacement recovery operation. Accordingly, the possibility that running out of ink that may occur if the detection temperature when performing the tank replacement recovery operation is high can be made further lower. To put the above configuration in general terms, before the elapsed time since a tank was mounted exceeds a predetermined time, the percentages of suction amounts per unit time when the detection temperature is low to suction amounts per unit time when the detection temperature is high are set smaller than the percentages after the elapsed time since a tank was mounted exceeds the predetermined time.

Note that as suction recovery control, a configuration has been conventionally known in which the suction strength when performing the tank replacement recovery operation is set greater than the suction strength when performing the refreshing operation under the same conditions. This is because it is necessary to make the suction strength for the tank replacement recovery operation greater than that for refreshing, in order to remove air bubbles taken in from a joint portion between the ink tank 6 and the printhead 3 when an ink tank is attached/detached. Here, if the suction strength when performing the tank replacement recovery operation is made greater than the suction strength when performing the refreshing operation under the same conditions, the suction parameter T1 may indicate the suction conditions with stronger suction than that for the suction parameter R1. However, with the configuration of Embodiment 3, the percentages of suction amounts per unit time for the low-temperature mode to suction amounts per unit time for the high temperature mode are set smaller when performing the tank replacement recovery operation than when performing the refreshing operation. Accordingly, even when the suction parameter T1 indicates the suction conditions with stronger suction than that for the suction parameter R1, it is possible to suppress running out of ink that may occur if the detection temperature when performing the tank replacement recovery operation is high.

Although the above embodiments are examples of typical embodiments of the present invention, the present invention is not limited to the embodiments described above and shown in the diagrams, and can be implemented with appropriate modifications within the range where the gist thereof is not changed.

For example, although in Embodiments 1 and 2 described above, a description has been given regarding the case where the suction recovery operation is switched between two levels (high-temperature mode, low-temperature mode) according to the detection temperature as an example, the suction recovery operation may be switched between three levels or more. For example, three levels are set, namely, 10° C. or lower, over 10° C. and up to 20° C., and over 20° C., and operation tables for a low-temperature mode, a normal-temperature mode, and a high-temperature mode are respectively set. At this time, the suction amounts for the tank replacement recovery operation implemented in the normal-temperature mode and the high-temperature mode are made smaller than the suction amounts for the refreshing operation implemented when the environmental temperature is the same. That is, the suction amounts per unit time are made smaller. Alternatively, a configuration is possible in which the tank replacement recovery operation and the refreshing operation are performed using the same suction amounts when in the low-temperature mode and the normal-temperature mode, and only when in the high-temperature mode, the suction amounts for the tank replacement recovery operation are made smaller than the suction amounts for the refreshing operation implemented when the environmental temperature is the same. In any case, it is sufficient to avoid a situation in which "strong suction" is executed on an ink tank whose ink temperature is low, and running out of ink occurs.

Further, the modified examples described below may be adopted for the refreshing operation. As one example, when the first refreshing operation after tank replacement is implemented before the estimation conformity time has elapsed, even if the detection temperature of the printing apparatus is high, "weak suction" is performed in accordance with R2. Here, the reason why the suction recovery operation is performed in accordance with R2 is that the temperature of an ink tank after replacement may be low at this point in time, and running out of ink may occur.

Furthermore, suppose that an instruction to execute the refreshing operation is given two times or more before the estimation conformity time has elapsed; when the third instruction is given, the operation may be switched to suction recovery using "strong suction" even before the estimation conformity time has elapsed. This is because it can be considered that the instruction to perform the refreshing operation has been given three times since the suction recovery operation using "weak suction" in accordance with R2 has been performed although the ink temperature was high, and thus bubbles in the nozzle have not been sufficiently discharged. It should be noted that the number of times here, namely two times or three times, is a mere example, and of course the number of times can be set as appropriate.

Further, the number of tanks that have been replaced may be detected, and when conditions regarding the detection temperature and the elapsed time since tank replacement are the same, the suction amount may be increased as the number of tanks that have been replaced increases.

Below, results of an experiment are described in the case where the suction recovery control of Embodiments 1 and 2 described above is implemented. Note that in the above embodiments, the configuration is such that cyan C, magenta M, yellow Y, and black K ink is sucked at the same time using a single cap. Here, the suction amounts for each color are described in such a configuration in which suction recovery is performed using a single cap with respect to a plurality of ink tanks, and it was confirmed whether or not running out of ink occurs.

FIG. 7 shows the results of suction amounts per unit time for each color when suction recovery was performed in accordance with the suction parameters of Embodiment 1 described above. FIG. 7 shows suction amounts per unit time when the suction operation was executed in accordance with R1 and T3 for when the ink temperature is 25° C. Further, the percentages of suction amounts per unit time under a predetermined condition (when the suction operation was implemented in accordance with the parameters for when the ink temperature is 5° C.) with respect to the above suction amounts are shown. As shown in FIG. 7, when the suction recovery operation was implemented in accordance with R1 and T3 when the ink temperature was 5° C., running out of Y color ink occurred with a frequency of once in three times. In contrast, when the suction recovery operation was implemented in accordance with R2 and T2 when the ink temperature was 5° C., running out of ink did not occur. That is, in the case where the ink temperature is 5° C., if the suction amounts are approximately 86% of the suction amounts per unit time for the suction operation implemented in accordance with R1 and T3, it is apparent that running out of ink does not occur. On the other hand, if the suction amounts are approximately 94% of the suction amounts per unit time for the suction operation implemented in accordance with R1 and T3, it is also apparent that there is the risk that running out of ink occurs. Therefore, in the present embodiment, as shown in FIG. 6, the suction amounts per unit time when the suction recovery operation is performed in accordance with R2 are set to approximately 88% to 92% of the case where the operation is performed in accordance with R1.

FIG. 8 shows percentages of suction amounts with respect to suction amounts per unit time shown in FIG. 7 (suction amounts when the ink temperature was 25° C. and the suction recovery operation was implemented in accordance with R1 and T3). Note that State 1 shows the results in the case where the ink temperature of only one color (Y color) was 5° C., and the ink temperatures of the other colors were 25° C., State 2 shows the results in the case where the ink temperature of only one color (M color) was 25° C., and the ink temperatures of the other colors were 5° C., and State 3 shows the results in the case where the ink temperatures of all the colors of ink were 5° C. Here, ink tanks whose ink temperature is low have the risk that running out of ink occurs. The Y color ink tank corresponds to a low-temperature ink tank in State 1, the Y color, C color, and K color ink tanks correspond to a low-temperature ink tank in State 2, and all the ink tanks correspond to a low-temperature ink tank in State 3. However, the results show that running out of ink did not occur in any of the ink tanks in States 1 to 3. This is because in the present embodiment, suction recovery in accordance with T1 is performed when there is the possibility of the occurrence of running out of ink (the detection temperature exceeds the reference temperature, and the elapsed time is equal to the conformity time or shorter), and thus the percentages of suction amounts for ink tanks whose ink temperature is low (5° C.) are 86% or lower. Note that suction amounts per unit time when the suction recovery operation is executed in accordance with T1 need to be in the range where running out of ink does not occur in the case where the tank temperature after replacement is lower than the reference temperature, and also need to be the amounts according to which the performance of the tank replacement recovery operation can be secured.

In contrast to the situation described above, consider the case where a high temperature ink tank is mounted when the environmental temperature of the printing apparatus is low (for example, 5° C.). In this case, although the temperature of ink tanks other than the replaced ink tank have conformed to the environmental temperature (low temperature), running out of ink does not occur. This is because the detection temperature is low, and thus the suction parameter R2 or T2 for the low-temperature mode is selected, and "weak suction" is executed. Moreover, this is because if a plurality of colors of ink are sucked at the same time with the use of the same cap, as shown in FIG. 8, the suction amount for a low-temperature ink tank is suppressed more in the case where a high temperature ink tank also exists, than the case where the temperatures of all the ink tanks are low (in this case, 5° C.).

FIG. 10 shows the percentages of the suction amounts under a predetermined condition (when the tank replacement recovery operation was implemented in accordance with R2 when the environmental temperature was 25° C.) with respect to the suction amounts per unit time shown in FIG. 7 (suction amounts when the suction recovery operation was performed in accordance with R1, and the environmental temperature was 25° C.). Note that FIG. 10 shows the results in the case where the temperature of only one color (M color) is 25° C., and the temperatures of the other colors are 5° C. (the same condition as State 2 shown in FIG. 7). In this case as well, the suction amounts for the suction recovery operation performed on the ink tanks of the colors other than magenta (i.e., low-temperature ink tanks) are approximately 83% of the suction amounts when implementing the suction recovery operation in accordance with R1. Accordingly, in Embodiment 2 as well, running out of ink did not occur in State 2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-109912 filed on Apr. 28, 2009, which is hereby incorporated by reference herein in its entirety.

What is claimed is:

1. A printing apparatus that prints an image using a printhead that discharges ink supplied from an ink tank that has a negative pressure generation chamber, and an ink storage chamber that is communicated with the negative pressure generation chamber and is for holding ink, the printing apparatus comprising:

a temperature sensor configured to detect an environmental temperature of the printing apparatus;

a suction unit configured to suck ink from the printhead according to a target suction amount indicating amount of ink that the suction unit should suck per unit time at a predetermined environmental temperature; and a controller configured to cause the suction unit to suck ink such that the target suction amount in a case where the environmental temperature detected by the temperature sensor is higher than a predetermined temperature is greater than the target suction amount in a case where the environmental temperature is lower than the predetermined temperature, wherein the controller causes, in a case where the environmental temperature is higher than the predetermined temperature, the suction unit to suck ink such that the target suction amount for when an elapsed time since the ink tank was mounted is longer than a predetermined time is greater than the target suction amount for when the elapsed time is shorter than the predetermined time.

2. The printing apparatus according to claim 1, wherein the controller causes, in a case where the elapsed time is shorter than the predetermined time, the suction unit to suck ink such that the target suction amount for when the environmental temperature is lower than the predetermined temperature is the same as the target suction amount for when the environmental temperature is higher than the predetermined temperature.

3. The printing apparatus according to claim 1, wherein the controller causes, regarding a percentage of the target suction amount for when the environmental temperature is higher than the predetermined temperature with respect to the target suction amount for when the environmental temperature is lower than the predetermined temperature, the percentage in a case where the elapsed time is shorter than the predetermined time to be lower than the percentage in a case where the elapsed time is longer than the predetermined time.

4. The printing apparatus according to claim 1, wherein in a case where a user has given a plurality of instructions to the suction unit to suck ink before the elapsed time exceeds the predetermined time, the controller causes, in a case where a next one of the instructions is given before the elapsed time exceeds the predetermined time, the target suction amount in a case where the environmental temperature is higher than the predetermined temperature to be higher than the target suction amount in a case where the elapsed time since the ink tank was mounted is longer than the predetermined time, and furthermore the environmental temperature is higher than the predetermined temperature.

5. The printing apparatus according to claim 1, wherein the suction unit sucks ink by providing a plurality of periods in which a suction negative pressure is applied to the printhead, with a period in which the suction negative pressure is not applied interposed therebetween.

6. The printing apparatus according to claim 1, wherein the suction unit is a suction pump, and the controller changes the target suction amount by changing an operating speed and a rotation amount of the suction pump.

7. The printing apparatus according to claim 5, wherein the unit time is a time from a beginning of the period in which the suction negative pressure is applied until when a greatest suction negative pressure is applied.

8. A method for recovering a printhead of a printing apparatus that prints an image using the printhead that discharges ink supplied from an ink tank that has a negative pressure generation chamber, and an ink storage chamber that is communicated with the negative pressure generation chamber and is for holding ink, the method comprising:

detecting an environmental temperature of the printing apparatus; and sucking the ink such from the printhead that a target suction amount indicating amount of ink that a suction unit should suck per unit time at a predetermined environmental temperature, in a case where the environmental temperature is higher than a predetermined temperature is greater than the target suction amount in a case where the detected environmental temperature is lower than the predetermined temperature, wherein in the suction, in a case where the environmental temperature is higher than the predetermined temperature, ink is sucked such that the target suction amount for when an elapsed time since the ink tank was mounted is longer than a predetermined time is greater than the target suction amount for when the elapsed time is shorter than the predetermined time.

* * * * *